US006710303B1

(12) United States Patent
Lorenzen

(10) Patent No.: US 6,710,303 B1
(45) Date of Patent: Mar. 23, 2004

(54) INTERMEDIATE ELECTRICAL CONNECTING DEVICE FOR SEAT-HEATING SYSTEMS

(75) Inventor: Guenter Lorenzen, Olching (DE)

(73) Assignee: W.E.T. Automotive Systems AG, Odelzhausen (DE)

( * ) Notice: Subject to any disclaimer, the term of this patent is extended or adjusted under 35 U.S.C. 154(b) by 0 days.

(21) Appl. No.: 10/365,067

(22) Filed: Feb. 12, 2003

Related U.S. Application Data

(60) Provisional application No. 60/425,958, filed on Nov. 13, 2002.

(51) Int. Cl.[7] ..... H05B 1/00; H05B 3/00

(52) U.S. Cl. ..... 219/217; 219/483; 338/289; 174/84 R; 174/88 R

(58) Field of Search ..... 219/200, 201, 219/217, 476, 480, 483, 541, 542, 552, 553; 338/333, 334, 295, 289, 288; 174/84 R, 88 R

(56) References Cited

U.S. PATENT DOCUMENTS

| | | | | | |
|---|---|---|---|---|---|
| 3,814,139 | A | * | 6/1974 | Loyd et al. | 138/141 |
| 3,904,847 | A | * | 9/1975 | Adams | 219/213 |
| 4,633,061 | A | * | 12/1986 | Arikawa | 219/202 |
| 4,691,188 | A | * | 9/1987 | Watanabe et al. | 338/307 |
| 4,788,404 | A | * | 11/1988 | Kent | 219/85.1 |
| 4,823,106 | A | * | 4/1989 | Lovell | 338/112 |
| 4,952,776 | A | * | 8/1990 | Huguet | 219/217 |
| 4,964,674 | A | * | 10/1990 | Altmann et al. | 297/180 |
| 5,068,637 | A | * | 11/1991 | Bayer | 338/57 |
| 5,084,917 | A | * | 2/1992 | Matsubara et al. | 4/237 |
| 5,111,025 | A | * | 5/1992 | Barma et al. | 219/217 |
| 5,565,121 | A | * | 10/1996 | Forslund | 219/217 |
| 5,723,845 | A | * | 3/1998 | Partington et al. | 219/217 |
| 5,821,465 | A | * | 10/1998 | Tanaka et al. | 174/88 R |
| 6,093,910 | A | * | 7/2000 | Mcclintock et al. | 219/217 |
| 6,150,642 | A | * | 11/2000 | Weiss et al. | 219/528 |
| 6,220,659 | B1 | * | 4/2001 | McDowell et al. | 297/280.12 |
| 6,376,773 | B1 | * | 4/2002 | Maegawa | 174/88 R |
| 2002/0056709 | A1 | * | 5/2002 | Burt | 219/217 |
| 2002/0185483 | A1 | * | 12/2002 | Check et al. | 219/217 |
| 2003/0024924 | A1 | * | 2/2003 | Fristedt | 219/497 |

* cited by examiner

*Primary Examiner*—Ehud Gartenberg
*Assistant Examiner*—L. Fastovsky

(57) ABSTRACT

An intermediate electrical connecting apparatus (14) for a seat-heating system (10) includes a first junction (48) and a second junction (50). The first junction (48) is electrically coupled to a first heating element segment (30) of a heating element (18). The second junction (50) is electrically coupled to a second heating element segment (32) of the heating element (18). A seam segment (52) is electrically coupled between the first junction (48) and the second junction (50) and includes a plurality of redundant electrically conductive connections (54), which have a spacing arrangement therebetween.

20 Claims, 3 Drawing Sheets

INTERMEDIATE ELECTRICAL CONNECTING DEVICE FOR SEAT-HEATING SYSTEMS

CROSS-REFERENCE TO RELATED APPLICATION

This application claims the benefit of U.S. Provisional Patent Application Ser. No. 60/425,958 filed Nov. 13, 2002, entitled "Electrical Connecting Means."

TECHNICAL FIELD

The present invention relates to seat-heating systems, and more particularly to an apparatus for preventing interruption of an electrical connection within a heating system of a seat.

BACKGROUND OF THE INVENTION

Electric heating systems are commonly used for heating of seats, such as in automotive vehicles. Seat-heating systems are typically and physically installed near an upper or outer surface of a seat, to ensure energy-favorable heat transfer. Many seat-heating systems employ heating strands, for example, as heating elements. The heating strands, typically, meander over an area of a seat and have a pair of ends coupled so as to receive a supply current. The heating strands in response to the supply current heat the surface of the seat.

Due to close proximity of the heating strand and the seat surface, damage to the heating strand can occur during sewing or stitching of the seat system, such as during stitching of a seat covering over a seat pan or seat back.

To avoid any appreciable damage to the heating strands and any interruption of an electrical connection throughout length of the heating strands, the heating strands are commonly "opened up" or severed in seam areas to create pairs of severed ends. The severed ends are connected to highly flexible connecting strands having a relatively larger cross-sectional area. Unfortunately, even with use of flexible connecting strands having cross-sectional areas of approximately 0.5 $mm^2$ to 1.0 $mm^2$, damage to the connecting strands during stitching of a seat cannot be prevented with any certainty. Current needles, especially needles used in the stitching of leather, may have cutting widths of up to 2 mm, and therefore may sever and thus completely interrupt an electrical connection in a flexible connecting strand having cross-sectional area as stated. The current needles may even sever connecting strands having greater cross-sectional areas or significantly damage the strands such that they are inoperative, operate inappropriately, or operate for only a short period of time due to thermal temperature breakdown or simply normal seat wear-and-tear to such a time when the strands eventually become inoperative.

A known method of avoiding appreciable damage to the connecting strands is to increase the gauge of the connecting strands such that the cross-sectional area of the connecting strands is larger than the diameter of the stitching needle in an attempt to provide more damage resistant connecting strands. One disadvantage associated with using connecting strands having increased gauge is dependancy on connecting strand cross-sectional area in relation to diameter of a stitching needle, which prevents use of connecting strands having uniform cross-sectional area. Also, use of nonuniform connecting strands and heavier gauge connecting strands increases manufacturing costs of a seat-heating system.

It is therefore desirable to provide an electrical connecting apparatus for use in seat-heating systems that is more resilient to stitching of a seat system and assures an impervious and robust electrical connection.

SUMMARY OF THE INVENTION

The present invention provides an apparatus for preventing interruption of an electrical connection within a heating system of a seat. An intermediate electrical connecting apparatus for a seat-heating system is provided and includes a first junction and a second junction. The first junction is electrically coupled to a first heating element segment of a heating element. The second junction is electrically coupled to a second heating element segment of the heating element. A seam segment is electrically coupled between the first junction and the second junction and includes a plurality of redundant electrically conductive connections, which have a spacing arrangement therebetween.

One of several advantages of the present invention is that it provides redundant connections for a seat-heating element within a stitching area. In so doing, the present invention prevents interruption in electrical continuity and maintains electrical connection integrity of the heating element in the stitching area.

Another advantage of the present invention is that it provides an intermediate apparatus with redundant connections that have varying spacing or spacing of a predetermined arrangement such that the probability of each connection being severed or damaged during stitching of a seam is reduced as compared with that of prior art techniques.

Furthermore, the present invention provides redundant electrically conductive connections that may have nonuniform or at least partially random spacing, which not only decreases probability of damage to the redundant connections but also minimizes costs in implementation thereof.

Moreover, the present invention is versatile in that it may be adapted to various electrical conductors for use in various applications.

Yet another advantage of the present invention is that it may be integrally formed during manufacturing of a heating element or may be applied during manufacturing of a seat system.

The present invention itself, together with further objects and attendant advantages, will be best understood by reference to the following detailed description, taken in conjunction with the accompanying drawing.

BRIEF DESCRIPTION OF THE DRAWINGS

For a more complete understanding of this invention reference should now be had to the embodiments illustrated in greater detail in the accompanying figures and described below by way of examples of the invention wherein.

DESCRIPTION OF THE PREFERRED EMBODIMENT(S)

Figure 1:
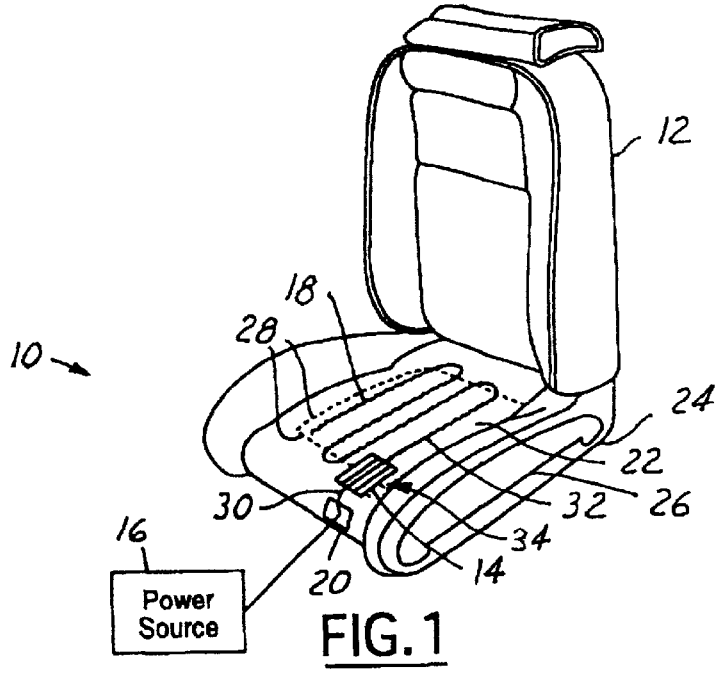
FIG. 1 is a perspective and block diagrammatic view of a seat-heating system of a vehicle incorporating an intermediate electrical connecting apparatus in accordance with an embodiment of the present invention.

In the following figures the same reference numerals will be used to refer to the same components. While the present invention is described with respect to an apparatus for preventing interruption of an electrical connection within a heating system of a seat, the present invention may be adapted and applied to various systems including: electrical systems, heating systems, seating systems, systems requiring electrical conductive connections within a seam area, vehicle systems, or other systems known in the art.

In the following description, various operating parameters and components are described for one constructed embodiment. These specific parameters and components are included as examples and are not meant to be limiting.

Also, in the following description the term "overstitching" refers to a needle or other stitching device in effect stitching or penetrating deep enough into a device being stitched such that damage or severing of electrical connections or of electrical devices can occur. For example, when a seam of a seat system is stitched, a stitching needle may extend deep enough into a seat pan and damage or sever various electrical connections contained therein.

Referring now to FIG. 1, a perspective and block diagrammatic view of a seat-heating system 10 within a seat system 12 incorporating an intermediate electrical connecting apparatus 14 in accordance with an embodiment of the present invention is shown. The seat-heating system 10 includes a power source 16 electrically coupled to a heating element 18, via a connector 20. Electrical power is transferred to the heating element 18 to warm an upper surface 22 of the seat 12. The heating element 18 is contained within a seat cover 24 and is beneath and near the upper surface 22 to provide efficient transfer of thermal energy from the heating element 18 to the upper surface 22. The seat cover 24 is stitched over the intermediate apparatus 14 and a seat pan 26. The seat cover 24 has a plurality of seams 28. The intermediate connecting apparatus 14 is coupled between a first heating element segment 30 and a second heating element segment 32 of the heating element 18 within a seam area 34. Although a single intermediate connecting apparatus is shown any number may be utilized.

Referring now to FIGS. 2A–2D, multiple intermediate electrical connecting apparatuses 40, 42, 44, and 46 are shown. The intermediate connecting apparatuses 40–46 include first junctions 48 electrically coupled to the first segment 30 and second junctions 50 electrically coupled to the second segment 32. Seam segments 52 are coupled between the first junctions 48 and the second junctions 50. The seam segments 52 have multiple redundant electrically conductive connections 54, each of which are coupled to both the first junctions 48 and the second junctions 50. The redundant connections 54 have uniform or nonuniform spacing 56 therebetween. Although each intermediate apparatus of FIGS. 2A–2D are shown having seven redundant connections, any number of redundant connections may be used.

The redundant connections 54 may be in the form of strands, wire, heating elements, conductors, conductors printed on plastic film such as a printed circuit board, or other redundant electrically conductive connections known in the art. The redundant connections 54 may be of various styles, types, and formed of various materials. In using different materials, properties, for example, in terms of flexibility, tensile strength, elasticity, electrical and mechanical resistance and the like, of the redundant connections 54 may vary and may be employed separately or simultaneously in order to realize an intermediate apparatus having suitable combined over-all properties for a particular application.

Figure 2A:
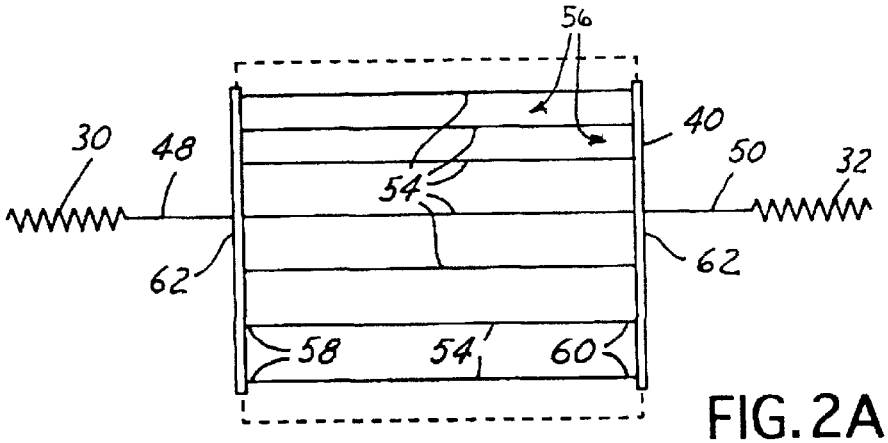
FIG. 2A is a top view of an intermediate electrical connecting apparatus having a pair of elongated connecting elements and a uniform spacing arrangement in accordance with an embodiment of the present invention.
Figure 2B:
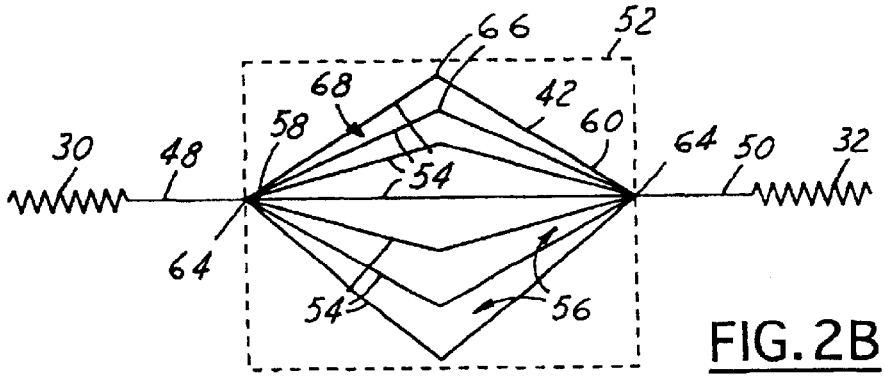
FIG. 2B is a top view of an intermediate electrical connecting apparatus having a quadrilaterally shaped spacing arrangement in accordance with another embodiment of the present invention.
Figure 2C:
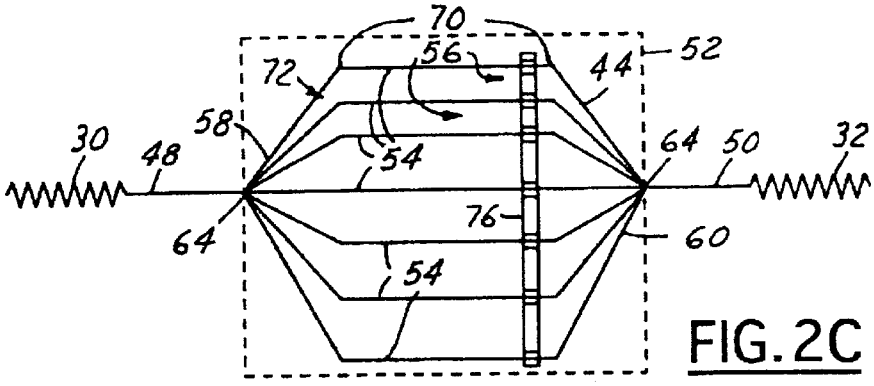
FIG. 2C is a top view of an intermediate electrical connecting apparatus having a hexagonally shaped spacing in accordance with another embodiment of the present invention.
Figure 2D:
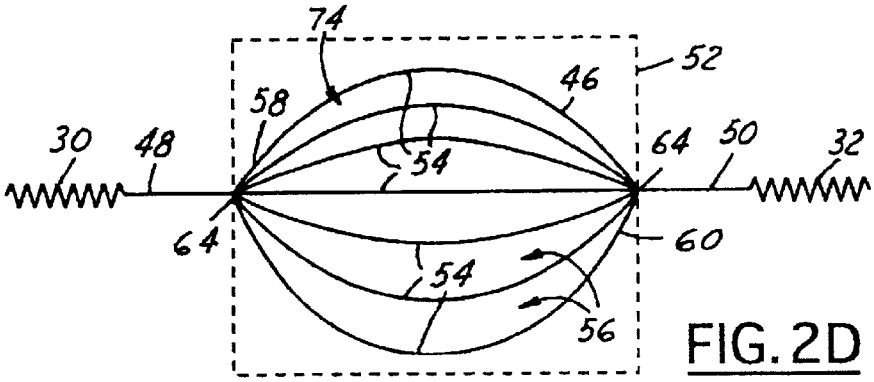
FIG. 2D is a top view of an intermediate electrical connecting apparatus having an eliptically shaped spacing in accordance with another embodiment of the present invention.

The redundant connections 54 have anterior ends 58 and posterior ends 60 that may be coupled to the first segment 30 and the second segment 32 directly, via elongated connecting elements 62, as shown in FIG. 2A, to connecting points 64, as shown in FIGS. 2B–2D, or by some other connecting technique known in the art. The elongated elements 62 may be in the form of a contact foil, a contact conductor, or other form of elongated element known in the art. The elongated elements 62 aid in providing a uniform spacing arrangement between the redundant connections 54. Use of the points of contact 64 provides a relatively more random spacing and relatively more compact arrangement than use of the elongated elements 62. Randomly spaced redundant connections simplifies assembly and manufacturing of a seat-heating system, since additional techniques, equipment, or components are not utilized to set the redundant connections in a predetermined arrangement, thus also minimizing costs associated therein.

In multiple embodiments of the present invention a predetermined spacing arrangement is achieved by suitable selection of material used to form the redundant connection 54 and by appropriately determined amounts of deformation of the material. For example, in FIGS. 2B–2D, the redundant connections 54 are deformed to form various spacing arrangements. Each of the spacing arrangements in FIGS. 2B–2D are at least partially uniform and have increasing and decreasing spacing distributions between the redundant connections 54. The intermediate apparatus 42, of FIG. 2B, has a single deflection point 66 for each redundant connection 54 and has a quadrilaterally shaped spacing arrangement 68. The intermediate apparatus 44, of FIG. 2C, has a pair of deflection points 70 for each redundant connection 54 and has a hexagonally shaped spacing arrangement 72. The intermediate apparatus 46, of FIG. 2D, does not have any deflection points and therefore has an eliptically shaped spacing arrangement 74. The spacing arrangements shown in FIGS. 2A–2D are shown for example purposes only; other spacing arrangements may be utilized.

The redundant connections 54 may be in a predetermined arrangement or in an arrangement according to a natural geometrical course, such as when naturally installing the intermediate apparatuses 40–46. The redundant connections 54 may be spaced apart with staggered distances therebetween that are increasing and decreasing between the first junctions 48 and the second junctions 50. The staggered spacing decreases the probability that each redundant connection 54 is damaged during stitching of a seam, especially when the stitching is performed in a uniform pattern. Uniform spacing between redundant connections, in general, provides ease of positioning of intermediate apparatuses with respect to a seam. The redundant connections 54 may be offset with a stitching pattern, such that stitching does not damage, or only minimally damages the connections 54.

In the embodiments of FIGS. 2B–2D, spacing between redundant connections 54 may be provided by spacers, such as conductive guides of paperboard or plastic sheet, depending upon the material and ability of the conductive elements to maintain desired spacing. An example spacer 76 is shown in FIG. 2C.

The redundant connections 54 may be coupled to each other, to the elongated elements 64, or to the points of contact 64 using various techniques known in the art such as crimping, ultrasonic welding, mechanical pressing, cold welding, soldering, or spotwise embedding in a conductive media.

Figure 3A:
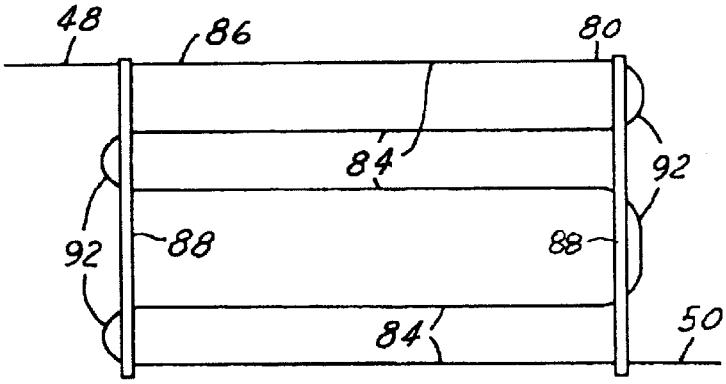
FIG. 3A is a top view of an intermediate electrical connecting apparatus having conductive connections configured in a single electrical conductor and which are spaced apart by elongated connecting elements in accordance with another embodiment of the present invention.
Figure 3B:
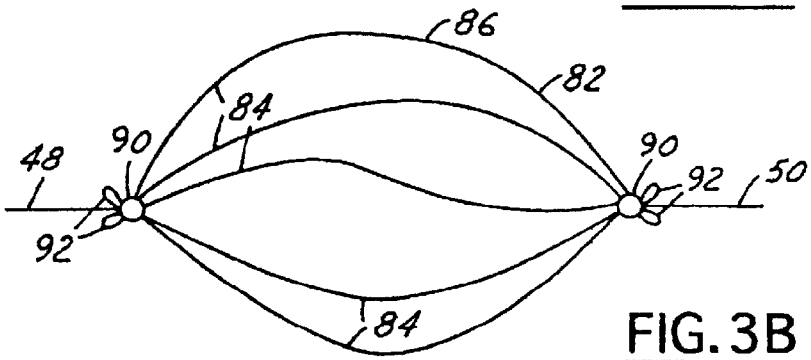
FIG. 3B is a top view of an intermediate electrical connecting apparatus having conductive connections configured in a single electrical conductor and which are coupled at a pair of connection points in, accordance with another embodiment of the present invention.

Referring now to FIGS. 3A and 3B, top views of intermediate electrical connecting apparatuses 80 and 82, are shown, having redundant connections 84 configured in single electrical conductors 86 in accordance with multiple embodiments of the present invention. The single electrical conductors 86 may be spaced apart via elongated elements 88, as shown in FIG. 3A, or may be held by points of contact 90, as shown in FIG. 3B. Of course, other configurations may be utilized.

Each single conductor 86 is arranged to form loop ends 92, which are electrically conductively connected to each other, via the elongated elements 88 and the points of contact 90. The elongated elements 88 unlike the points of contact 90 may be used to space apart redundant connections 84 at various separation distances. The elongated elements 88 also allow for geometrical course or arrangement of the redundant connections 84 in a preassigned manner without additional methods or equipment. On the other hand, the points of contact 90, unlike the elongated segments 88, allow the redundant connections 84 to have a more random spacing arrangement.

Figure 4:
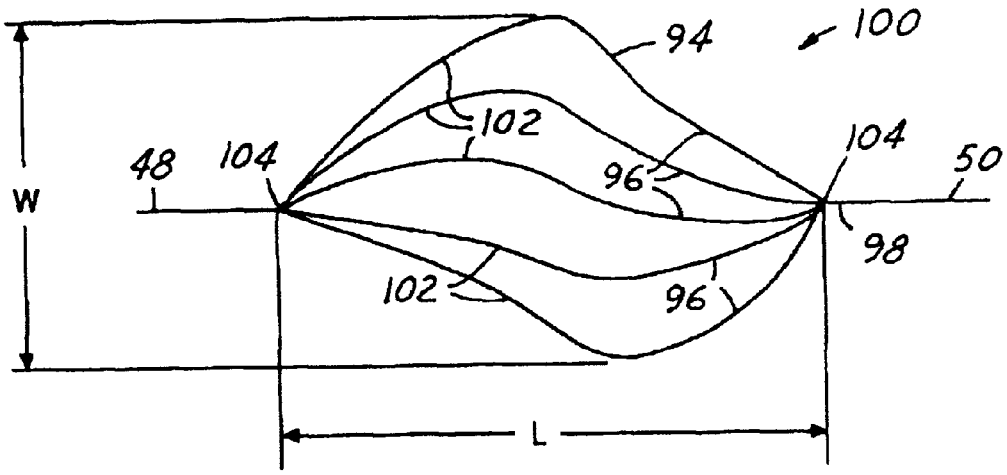
FIG. 4 is a top view of an intermediate electrical connecting apparatus having multiple skeins in accordance with multiple embodiments of the present invention.

Referring now to FIG. 4, a top view of an intermediate electrical connecting apparatus 94 having multiple skeins 96 in accordance with an embodiment of the present invention is shown. In this embodiment of the present invention an opposedly wound electrically conductive multiple strand device 98 is provided having skeins 96. The opposedly wound device 98 is preferably flexible and has at least three skeins braided in a long pitch. The opposedly wound device 98 is cropped to expose the skeins 96 and provides an intermediate range 100 having a length L and a width W that is approximately equal to a length and width of a corresponding seam area. The length L may also correspond with a length of a corresponding seam segment. The skeins 96 within the intermediate range 100 are contrarily twisted and fanned to form redundant connections 102, which are similar to the redundant connections described above.

The skeins 96, as with the redundant connections above, may be of various style and type and may be formed of various materials. The skeins 96 may be simply wires or may be in the form of some other type of conductive device known in the art. Each skein 96 of the opposedly wound device 98 is electrically conductively connected at each end 104. Use of the intermediate apparatus 94 is advantageous when heating elements are employed as seat-heating agents, since the opposedly wound device 98 may be simply produced and integrally configured with the heating elements. The production of the intermediate apparatus 94 is simple to implement and economical.

As stated, the intermediate apparatus 94 may be integrally formed with heating elements of a seat-heating system. In particular, when the heating elements are in the form of uninsulated heating strands, the redundant connections 102 may be realized as an integral component of the heating elements. The shape of the redundant connections 102 maybe pre-formed by the geometrical course of the heating strands.

Figure 5:
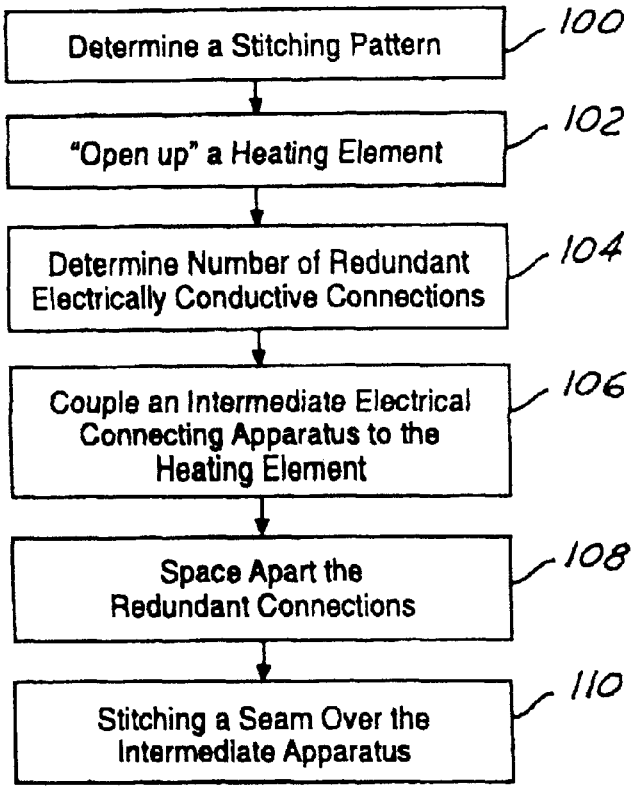
FIG. 5 is a logic flow diagram illustrating a method of manufacturing a seat system in accordance with multiple embodiments of the present invention.

Referring now to FIG. 5, a logic flow diagram illustrating a method of manufacturing a seat system in accordance with multiple embodiments of the present invention is shown.

In step 100, a stitching pattern is determined. As known in the art, seat system s typically have a stitching pattern or design including distances between stitches and location of stitches.

In step 102, a heating element in a seam area is opened up to form a first heating element segment and a second heating element segment, using methods known in the art.

In step 104, a number of redundant electrically conductive connections are determined in response to the stitching pattern. The number of redundant connections is determined in response to the stitching pattern and a desired probability of a needle hitting or damaging the redundant connections. The probability may be reduced by incorporating an increased number of redundant connections. The probability of a needle hitting or damaging the redundant connections may be determined in response to: number of stitches per unit length or area, type and location of the seam, type of materials to be sewn, the performance requirements of the heating elements to be connected, desired safety requirements, the number of overstitchings, and other seat-heating system factors known in the art.

In step 106, an intermediate electrical connecting apparatus, having the number of redundant connections determined in step 104 and as described above, is coupled to the first heating element segment and the second heating element segment, using electrical coupling techniques known in the art.

In step 108, the redundant connections are spaced apart. The connections may be formed, adjusted, bent, naturally separated, separated by an elongated element, separated by spacers, or separated using some other technique known in the art. The spacing arrangement may be predetermined and may have various predetermined spacing distributions between connections.

The spacing may be determined in response to a determined stitching pattern. In an expedient embodiment of the invention, the distances between the several redundant connections are determined by an aleatory principle. The aleatory principle refers to randomly occurring spacing during manufacturing of a seat-heating system. Use of an aleatory principle is especially advantageous economically, since the spacings are selected in a random fashion or as they happen to occur in assembling of the seat-heating system and since additional equipment, techniques, or operations are not utilized to arrange the redundant connections to have predetermined spacing distances therebetween.

Predetermined spacing of redundant connections is preferred when a stitching pattern has been determined and the type and size of the stitching equipment, such as stitching needle diameter, is known. A suitable predetermined selection of the spacings achieves a high degree of overstitch safety even when positioning of an intermediate apparatus is varied with respect to a seam. Also, a suitable predetermined selection of spacings may allow for a reduced number of redundant connections to maintain a desired level of overstitch safety. It can be advantageous when the spacings are configured to have staggered spacing distance with increasing and/or decreasing distances therebetween.

In step 110, the seam is stitched over the intermediate apparatus while maintaining electrical continuity and integrity between a first junction and a second junction of the intermediate apparatus.

The above-described steps are meant to be an illustrative example, the steps may be performed synchronously, sequentially, simultaneously, or in a different order depending upon the application.

The present invention by having multiple electrically conductive connections with various spacing arrangements allows use of various stitching needles having various stitching needle widths, which is unlike that of the prior art in which stitching needle width was of a primary concern. The present invention, by considering the severing of or damage to one or more of the redundant connections when determining spacing between electrical connections, minimizes the likelihood of damage to the connections during stitching of a seam. The present invention allows for reduced cross-sectional area of an electrically conductive connection in providing multiple redundant connections over that of the prior art in which an electrically conductive connecting strand of larger gauge was used to account for potential stitching damage.

Also, the present invention has an intermediate apparatus with a total cross-section or area of coverage that is distributed over a relatively larger seat surface area, and therefore the probability of a needle hitting or damaging the intermediate apparatus to such a degree to render the apparatus inoperative is negligible. Thus, although a stitch may damage a single one or even several redundant connections, electrical conductivity and integrity is maintained and ensured by the number and arrangement of redundant connections.

The present invention provides a versatile, simple to implement, overstitch safe, cost effective, intermediate connecting apparatus that maintains electrical conductivity and integrity across seam areas during manufacturing of a seat system.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. An intermediate electrical connecting apparatus for a seat-heating system comprising:

a first junction electrically coupled to a first heating element segment of at least one heating element;

a second junction electrically coupled to a second heating element segment of said at least one heating element; and a seam segment electrically coupled between said first junction and said second junction, said seam segment comprising a plurality of redundant electrically conductive connections having a spacing arrangement therebetween.

2. An apparatus as in claim 1 wherein said plurality of redundant electrically conductive connections are coupled directly to said first junction and said second junction.

3. An apparatus as in claim 1 wherein said plurality of redundant electrically conductive connections are coupled to said first junction and said second junction via at least one coupling device selected from a contact foil, a contact conductor, a contact, and a connection.

4. An apparatus as in claim 1 wherein said plurality of redundant electrically conductive connections have spacing selected from at least one of equal spacing, varying spacing, staggered spacing, increasing spacing, decreasing spacing, predetermined spacing, and spacing determined in respect to an aleatory principle.

5. An apparatus as in claim 1 wherein at least one space between said plurality of redundant electrically conductive connections has a nonuniform spacing distribution.

6. An apparatus as in claim 1 wherein said plurality of redundant electrically conductive connections are configured in at least one electrical conductor.

7. An apparatus as in claim 6 wherein said at least one electrical conductor is in the form of printed conductors on a plastic film.

8. An apparatus as in claim 6 wherein said at least one electrical conductor is arranged in a plurality of loops having a plurality of anterior and posterior ends.

9. An apparatus as in claim 8 wherein at least a portion of said plurality of anterior and posterior ends are coupled to each other by at least one elongated connecting element.

10. An apparatus as in claim 8 wherein at least a portion of said plurality of anterior and posterior ends are coupled to each other via at least one junction.

11. An apparatus as in claim 8 wherein at least a portion of said plurality of anterior and posterior ends are electrically conductively connected by at least one geometrically or dynamically positive connecting method selected from pressing, crimping, soldering, welding, and embedding in a conductive media.

12. An apparatus as in claim 1 wherein at least a portion of said plurality of redundant electrically conductive connections are electrically conductively connected by at least one geometrically or dynamically positive connecting method selected from pressing, crimping, soldering, welding, and embedding in a conductive media.

13. An apparatus as in claim 1 wherein said plurality of redundant electrically conductive connections are formed by skeins of an electrically conductive multiple strand device.

14. An apparatus as in claim 13 wherein said skeins are of an opposedly twisted electrically conductive multiple strand device.

15. An apparatus as in claim 1 wherein said plurality of redundant electrically conductive connections are spaced apart by at least one spacer.

16. An apparatus as in claim 15 wherein said at least one spacer is selected from at least one of an overstitchable spacer, a paperboard sheet, and a plastic sheet.

17. A seat-heating system comprising:

at least one seat-heating element having a first segment and a second segment; and an intermediate electrical connecting apparatus comprising;

a first junction electrically coupled to said first heating element segment;

a second junction electrically coupled to said second heating element segment; and a seam segment electrically coupled between said first junction and said second junction, said seam segment comprising a plurality of redundant electrically conductive connections having a predetermined spacing arrangement therebetween.

18. An apparatus as in claim 17 wherein said plurality of redundant electrically conductive connections are configured in at least one electrical conductor.

19. An apparatus as in claim 17 wherein said plurality of redundant electrically conductive connections are formed by skeins of an electrically conductive multiple strand device.

20. A method of manufacturing a seat system comprising:

opening up a heating element in a seam area of a seam to form a first heating element segment and a second heating element segment;

coupling an intermediate electrical connecting apparatus to said first heating element segment and said second heating element segment;

spacing a plurality of redundant electrically conductive connections apart; and stitching said seam while maintaining electrical continuity and integrity between a first junction and a second junction of said intermediate electrical connecting apparatus.

* * * * *